US009633617B2

(12) United States Patent
Nakata et al.

(10) Patent No.: US 9,633,617 B2
(45) Date of Patent: Apr. 25, 2017

(54) LIQUID CRYSTAL DISPLAY DEVICE WITH DRIVE CONTROL CIRCUIT AND METHOD FOR DRIVING SAME

(75) Inventors: Jun Nakata, Osaka (JP); Akizumi Fujioka, Osaka (JP); Kohzoh Takahashi, Osaka (JP); Toshihiro Yanagi, Osaka (JP); Masami Ozaki, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 16 days.

(21) Appl. No.: 14/123,991

(22) PCT Filed: Jul. 2, 2012

(86) PCT No.: PCT/JP2012/066924

§ 371 (c)(1),
(2), (4) Date: Dec. 5, 2013

(87) PCT Pub. No.: WO2013/008668

PCT Pub. Date: Jan. 17, 2013

(65) Prior Publication Data

US 2014/0125569 A1 May 8, 2014

(30) Foreign Application Priority Data

Jul. 8, 2011 (JP) ..... 2011-152199
Feb. 10, 2012 (JP) ..... 2012-027599

(51) Int. Cl.
*G09G 3/36* (2006.01)

(52) U.S. Cl.
CPC ..... *G09G 3/3622* (2013.01); *G09G 3/3648* (2013.01); *G09G 2310/0202* (2013.01); *G09G 2310/08* (2013.01); *G09G 2320/0252* (2013.01); *G09G 2320/0257* (2013.01); *G09G 2320/041* (2013.01); *G09G 2340/0435* (2013.01); *G09G 2380/14* (2013.01)

(58) Field of Classification Search
CPC .. G09G 3/3611; G09G 3/3614; G09G 3/3677; G09G 3/3406; G09G 3/36
USPC ..... 345/87–100, 204, 214, 589
See application file for complete search history.

(56) References Cited

U.S. PATENT DOCUMENTS

2002/0093473 A1* 7/2002 Tanaka et al. ..... 345/87
2002/0180673 A1 12/2002 Tsuda et al.
(Continued)

FOREIGN PATENT DOCUMENTS

JP 2003-131632 A 5/2003
JP 2003-131633 A 5/2003
JP 2004-078124 A 3/2004
JP 2008-233925 A 10/2008
(Continued)

OTHER PUBLICATIONS

Official Communication issued in International Patent Application No. PCT/JP2012/066924, mailed on Jul. 24, 2012.

*Primary Examiner* — Jennifer Mehmood
*Assistant Examiner* — James Nokham
(74) *Attorney, Agent, or Firm* — Keating & Bennett, LLP

(57) ABSTRACT

According to a liquid crystal display device (1), a gate driver is controlled to (a) scan all of scan signal lines during at least two driving frames contained in a first driving period and (b) not scan any of the scan signal lines during pausing frames in a pausing period which is (i) secured between the first driving period and a second driving period by which the first driving period is followed and (ii) is longer than each of the first and second driving periods.

9 Claims, 15 Drawing Sheets

(56) References Cited

U.S. PATENT DOCUMENTS

| | | | | |
|---|---|---|---|---|
| 2003/0058232 | A1* | 3/2003 | Washio | G09G 3/3648 345/204 |
| 2003/0080951 | A1 | 5/2003 | Fujiwara et al. | |
| 2004/0036669 | A1* | 2/2004 | Yanagi | G06F 1/3218 345/98 |
| 2005/0184946 | A1* | 8/2005 | Pyoun | G09G 3/3677 345/94 |
| 2005/0231453 | A1* | 10/2005 | Park | G09G 3/3611 345/87 |
| 2008/0043027 | A1* | 2/2008 | Shiomi et al. | 345/501 |
| 2009/0115772 | A1* | 5/2009 | Shiomi | G09G 3/342 345/214 |
| 2009/0189886 | A1* | 7/2009 | Tsai | G09G 3/3611 345/214 |
| 2010/0033450 | A1 | 2/2010 | Koyama et al. | |
| 2010/0065837 | A1* | 3/2010 | Omura et al. | 257/43 |
| 2010/0289731 | A1 | 11/2010 | Matsumoto | |
| 2011/0084980 | A1* | 4/2011 | Lee | G09G 3/3406 345/589 |
| 2011/0109666 | A1 | 5/2011 | Owa et al. | |
| 2012/0212520 | A1 | 8/2012 | Matsui et al. | |

FOREIGN PATENT DOCUMENTS

| | | | |
|---|---|---|---|
| JP | 2009-276653 | A | 11/2009 |
| JP | 2010-49206 | A | 3/2010 |
| JP | 2010-061647 | A | 3/2010 |
| JP | 2010-086637 | A | 4/2010 |
| JP | 2010-266523 | A | 11/2010 |
| JP | 2011-102876 | A | 5/2011 |
| JP | 2011-123088 | A | 6/2011 |
| WO | 2011/043290 | A1 | 4/2011 |

* cited by examiner

LIQUID CRYSTAL DISPLAY DEVICE WITH DRIVE CONTROL CIRCUIT AND METHOD FOR DRIVING SAME

TECHNICAL FIELD

The present invention relates to a liquid crystal display device and a method of driving the liquid crystal display device.

BACKGROUND ART

In recent years, thin, light, and low-power-consumption display devices such as liquid crystal display devices have been widely used. It is noteworthy that such display devices have been mounted, for example, on mobile phones, smartphones, laptop personal computers, and the like. It is also expected that in the future, development and prevalence of electronic paper, which is even a thinner display device, will be rapidly advanced. Under such circumstances, it is now a common challenge to reduce power consumption of display devices.

Most recently, for a reduction in power consumption while a liquid crystal display device is being driven, a display device driving method has been disclosed that achieves low power consumption by allowing for a pausing period during which all scan signal lines are in a non-scanning state. For example, Patent Literature 1 discloses a driving method in which a pausing period (non-refreshing period) is provided between scanning periods (refreshing periods) during which a screen is scanned. In addition, the technology disclosed in Patent Literature 1 significantly reduces power consumption during a pausing period by suspending driving of a clock signal generation circuit which (i) generates a clock signal to be used for writing a data signal into a data signal line and (ii) consumes a large amount of electric power.

Citation List

Patent Literature

Patent Literature 1

Japanese Patent Application Publication, Tokukai, No. 2004-78124 A (Publication Date: Mar. 11, 2004)

SUMMARY OF INVENTION

Technical Problem

According to a driving method such as the technology of Patent Literature 1 in which a pausing period is provided, a larger number of frames (pausing frames) during a pausing period allows for a more significant reduction in electric power consumption. However, a larger number of pausing frames causes a screen to be updated a fewer number of times per unit of time. As a result, a drive frequency (refresh rate) of each pixel decreases. This, in combination with response characteristics of liquid crystals, causes the occurrence of such a phenomenon as afterimages. This phenomenon will be described below with an example in which a conventional liquid crystal display device is driven with driving timings illustrated in FIG. 15. FIG. 15 is a timing chart illustrating a driving method in which, as with the technology disclosed in Patent Literature 1, a pausing period is provided between scanning periods. In the example, it is assumed that (i) a scanning period is made up of one frame (the frame indicated as "D" in FIG. 15) and (ii) voltage for white display is applied during the scanning period.

FIG. 14 is an enlarged view illustrating a pixel of a conventional liquid crystal display device. As illustrated in FIG. 14, a TFT3 provided in each pixel has a source electrode, a gate electrode, and a drain electrode, which are electrically connected to a data signal line S(n), a scan signal line G(m), and a pixel electrode 5, respectively. A liquid crystal capacitance Clc is stored between the pixel electrode and a counter electrode. A voltage corresponding to a data signal is to be applied to the liquid crystal capacitance Clc via the data signal line S(n) and then the TFT3. This allows an image corresponding to the data signal to be displayed.

Note that the liquid crystal capacitance Clc is represented by the following equation:

$$Clc=\in\times S/d$$

where $\in$ is a liquid crystal dielectric constant; S is a surface area over which the drain electrode and a common electrode face each other; and d is a distance between the drain electrode and the common electrode.

Liquid crystals have such a characteristic as dielectric anisotropy. The liquid crystal dielectric constant $\in$ varies, depending on an alignment direction of liquid crystal molecules. Specifically, since the transmissivity of liquid crystals is controlled by the alignment direction of the liquid crystal molecules, the liquid crystal dielectric constant $\in$ varies, depending on a gradation.

According to such a principle, application of a voltage Vlcd1 (for white display during the scanning period (refreshing frame)) to the liquid crystal capacitance Clc causes the liquid crystal molecules to be aligned in a direction corresponding to the voltage Vlcd1. However, it takes a certain length of time for the liquid crystal molecules to be aligned in the direction corresponding to a voltage Vlcd. This prevents a change in the alignment status of the liquid crystal molecules from keeping up with a change in a voltage Vlcd within an updating period (scanning period), and therefore causes a change in the liquid crystal capacitance Clc to occur later than does a change in the voltage Vlcd. As a result, the liquid crystal capacitance Clc fails to reach a necessary liquid crystal capacitance (indicated by a dot-and-dash line in FIG. 15) at the end of the updating period, and therefore the voltage Vlcd becomes lowered in response to the change in the liquid crystal capacitance Clc. This prevents the voltage Vlcd from reaching the voltage Vlcd1 which is necessary for white display. Since the voltage Vlcd does not reach the desired voltage Vlcd1 but ends up at a voltage Vlcd2 (indicated by a dot-and-dash line in FIG. 15) which differs from the voltage Vlcd1, this difference results in recognizable afterimages on a screen.

The present invention has been made in view of the problem, and it is an object of the present invention to provide (i) a liquid crystal display device capable of suppressing the occurrence of afterimages as well as reducing electric power consumption and (ii) a method of driving the liquid crystal display device.

Solution to Problem

In order to attain the object, a liquid crystal display device in accordance with an embodiment of the present invention includes: a plurality of scan signal lines; a plurality of data signal lines; pixels provided for intersections of the plurality of scan signal lines and the plurality of data signal lines; a scan signal line drive circuit for selectively scanning the scan signal lines; a data signal line drive circuit for supplying data signals via the respective plurality of data signal lines; and a drive control section for controlling the scan signal line drive circuit (i) to scan all of the plurality of scan signal lines during at least two driving frames contained in a first driving period and (ii) not to scan any of the plurality of scan signal lines during pausing frames in a pausing period which (i) is secured between the first driving period and a second driving period by which the first driving period is followed and (ii) is longer than each of the first and second driving periods.

According to the configuration, the data signals (voltages necessary for display) are written into the respective data signal lines during the driving frames of a driving period. In other words, the pixels are refreshed in each driving frame. Consequently, over a first driving frame, a liquid crystal capacitance does not reach a liquid crystal capacitance necessary for display, and an applied voltage decreases accordingly. However, the voltage necessary for the display is applied again over second and subsequent driving frames, the liquid crystal capacitance reaches the liquid crystal capacitance necessary for display. This causes the applied voltage to reach the necessary voltage as well.

Each driving period thus contains at least two driving frames in each of which data signals are written into the respective data signal lines, and the pixels are therefore refreshed for each driving period. This causes the liquid crystal capacitance to reach the necessary liquid crystal capacitance within the driving period, and consequently causes the applied voltage to reach the necessary voltage within the driving period. Therefore, it is possible to realize display on the screen without afterimages.

Additionally, according to the liquid crystal display device, all the scan signal lines are in a non-scanning state in which not to scan the signal lines. This prevents data signals from being written into the respective data signal lines. so that driving of any of the circuits is suspended. This allows for a reduction in electric power consumption. Furthermore, each pausing period is set to be longer than each driving period. This allows for a sufficient reduction in electric power consumption even though each driving period contains a plurality of driving frames. Hence, it is possible to provide a liquid crystal display device that (i) achieves a reduction in electric power consumption and (ii) achieves high quality display with reduced afterimages.

In order to attain the object, a method in accordance with the embodiment of the present invention is a method of driving a liquid crystal display device, said liquid crystal display device including: a plurality of scan signal lines; a plurality of data signal lines; pixels provided for intersections of the plurality of scan signal lines and the plurality of data signal lines; a scan signal line drive circuit for selectively scanning the scan signal lines; a data signal line drive circuit for supplying data signals via the respective plurality of data signal lines; and said method including the step of: controlling the scan signal line drive circuit (i) to scan all of the plurality of scan signal lines during at least two driving frames contained in a first driving period and (ii) not to scan any of the plurality of scan signal lines during pausing frames in a pausing period which (i) is secured between the first driving period and a second driving period by which the first driving period is followed and (ii) is longer than each of the first and second driving periods.

With the method, it is possible to (i) achieve a reduction in electric power consumption and (ii) achieve high quality display with reduced afterimages.

Additional objects, features, and strengths of the present invention will be made clear by the description below. Furthermore, the advantages of the present invention will be evident from the following explanation with reference to the drawings.

Advantageous Effects of Invention

According to a liquid crystal display device in accordance with an embodiment of the present invention, each driving period thus contains at least two driving frames in each of which data signals are written into the respective data signal lines and the pixels are therefore refreshed. This allows the liquid crystal capacitance to reach a necessary liquid crystal capacitance within the driving period, and consequently allows the applied voltage to reach the necessary voltage within the driving period. Therefore, it is possible to realize display on the screen without afterimages.

Additionally, according to the liquid crystal display device, all the scan signal lines are in a non-scanning state in which not to scan the signal lines. This prevents data signals from being written into the respective data signal lines, so that driving of any of the circuits is suspended. This allows for a reduction in electric power consumption. Furthermore, each pausing period is set to be longer than each driving period. This allows for a sufficient reduction in electric power consumption even though each driving period includes a plurality of driving frames. Hence, it is possible to provide a liquid crystal display device that (i) achieves a reduction in electric power consumption and (ii) achieves high quality display with reduced afterimages.

Figure 12:
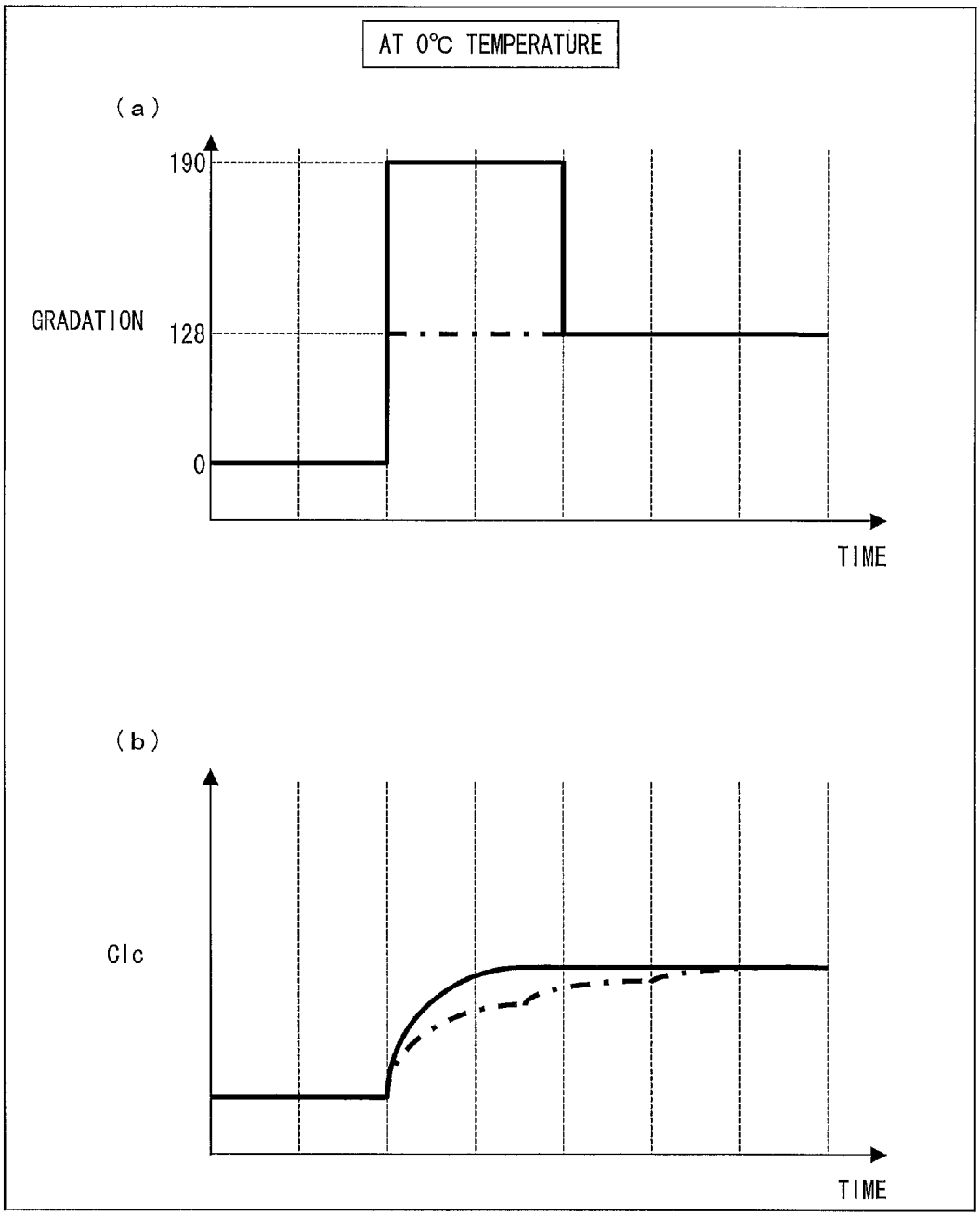

FIG. 12 is a set of views (a) and (b), (a) of FIG. 12 illustrating respective gradations to be written during OS driving and normal driving correspond, and (b) of FIG. 12 illustrating respective liquid crystal capacitances during the OS driving and the normal driving.

Figure 13:
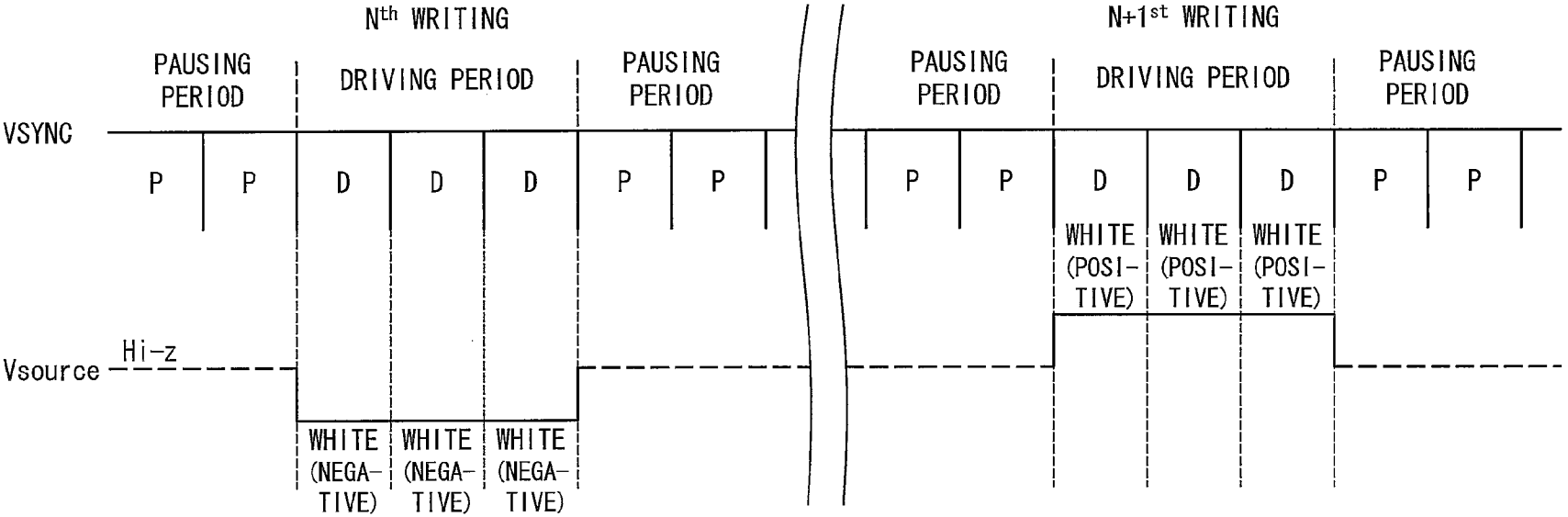

FIG. 13 is a view illustrating an example of timings at which the liquid crystal display device in accordance with the embodiment of the present invention is driven in a case where a reverse polarity driving method is employed.

Figure 14:
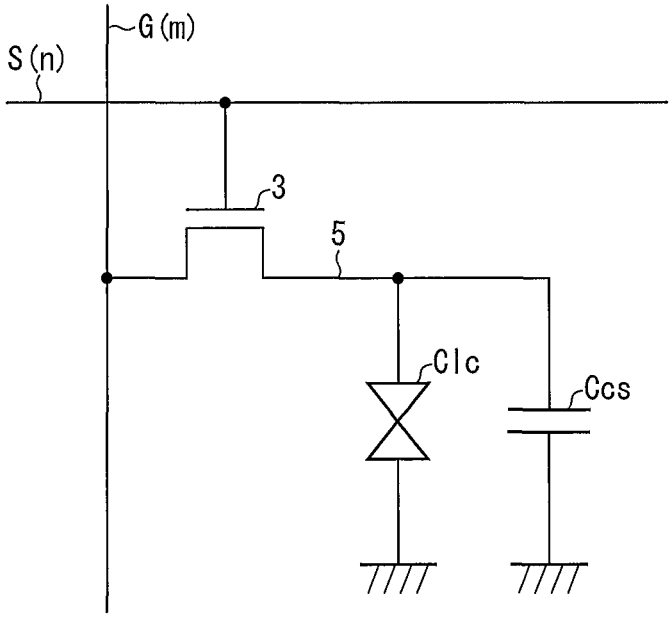

FIG. 14 is an enlarged view of a pixel in a conventional liquid crystal display device.

Figure 15:
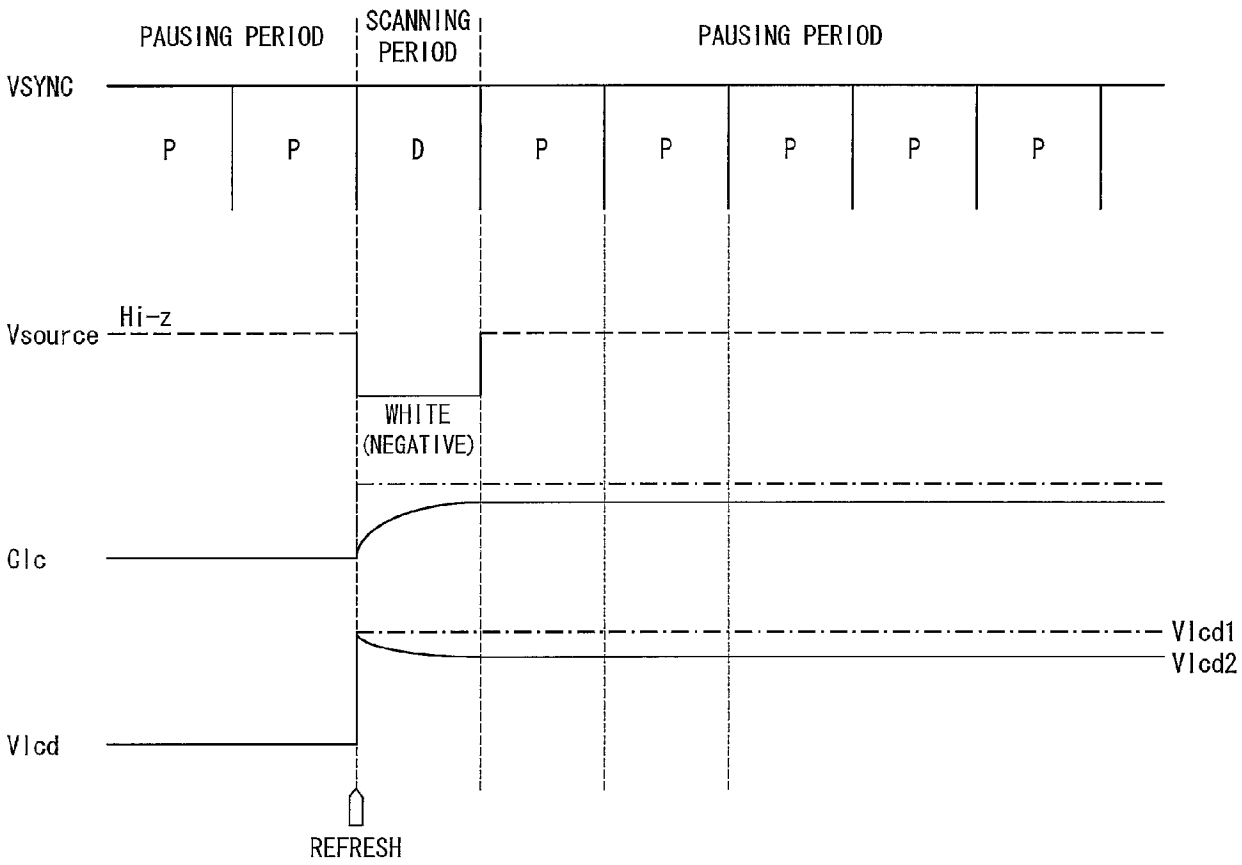
FIG. 15 PRIOR ART

FIG. 15 is a timing chart illustrating a driving method in which a scanning period is sandwiched between pausing periods.

DESCRIPTION OF EMBODIMENTS

The following description will discuss an embodiment of the present invention with reference to the drawings. Note that members similar in function and effect to those already described will be given the same reference signs, and their descriptions will be omitted.

(Configuration of Liquid Crystal Display Device 1)

Figure 2:
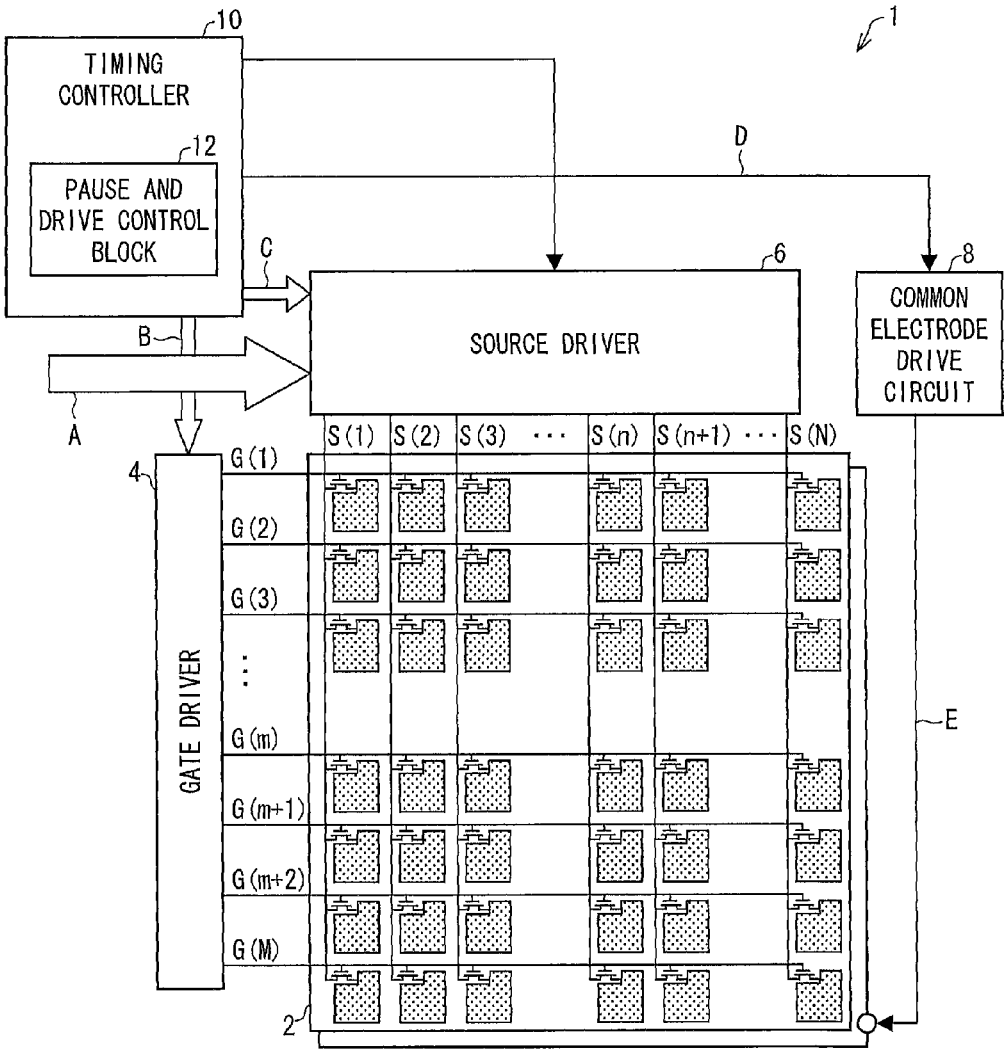
FIG. 2 is a view illustrating the entire configuration of the liquid crystal display device in accordance with the embodiment of the present invention.

First, a configuration of a liquid crystal display device 1 of the present embodiment will be described below with reference to FIG. 2. FIG. 2 is a view illustrating an overall configuration of the liquid crystal display device 1. As illustrated in FIG. 2, the liquid crystal display device 1 includes a display panel 2, a gate driver 4 (scan signal line drive circuit), a source driver 6 (data signal line drive circuit), a common electrode drive circuit 8, and a timing controller 10. The timing controller 10 includes a pause and drive control block 12 (drive control section).

The display panel 2*a* includes (i) a screen made up of pixels that are arranged in a matrix manner, (ii) N (N is a given integer) scan signal lines G (gate lines) that are selected line-sequentially so that the screen is scanned, and (iii) M (M is a given integer) data signal lines S (source lines) via each of which a data signal is supplied to a single row of pixels on a selected line. The scan signal lines G and the data signal lines S are orthogonal to each other. The pixels are provided for respective intersections of the scan signal lines G and the data signal lines S. In other words, each of the pixels is defined by a region enclosed with two adjacent scan signal lines G and two adjacent data signal lines S.

G(m) illustrated in FIG. 2 indicates an m-th (m is a given integer) scan signal line G. For example, scan signal line G(1), G(2), and G(3) indicate first, second, and third scan signal lines G, respectively. S(n) indicates an n-th (n is a given integer) data signal line S. For example, S(1), S(2), and S(3) indicate first, second, and third data signal lines S, respectively.

Note that, for simplicity, the present embodiment will deal with an example for driving of an equivalent circuit. Each pixel in the display panel 2 includes a switching element (TFT) whose drain is connected to a corresponding pixel electrode (not illustrated).

The gate driver 4 line-sequentially scans the scan signal lines G from the top to the bottom of the screen. In so doing, the gate driver 4 supplies, to each of the scan signal lines G, a rectangular-wave signal that turns on a corresponding TFT connected to the corresponding pixel electrode. This causes each of a single row of pixels of the screen to be in a selected state.

In accordance with an externally supplied video signal (indicated by an arrow A), the source driver 6 (i) calculates voltages that are to be supplied to a single row of respective pixels on a selected line, and then (ii) supplies the voltages to the respective data signal lines S. This causes the pixels on the selected scan signal lines G to receive image data (data signal).

The liquid crystal display device 1 further includes a common electrode (COM: not illustrated) provided for all the pixels of the screen. In response to a polarity inversion signal (indicated by an arrow D) supplied from the timing controller 10, the common electrode drive circuit 8 outputs, to the common electrode, a predetermined common voltage. This causes the common electrode to be driven.

The pause and drive control block 12 supplies, to analogue amplifiers of which the source driver 6 is made up, AMP_Enable signals at respective predetermined timings. Note that each of the AMP_Enable signals is a control signal for controlling an operation status of a corresponding analogue amplifier. The analogue amplifiers each (i) operate while a corresponding AMP_Enable signal is at a high level, and (ii) take a pause while the corresponding AMP_Enable signal is at a low level.

(Driving of Liquid Crystal Display Device 1)

Driving of the liquid crystal display device 1 will be briefly described below. First, the timing controller 10 receives, as input video image sync signals, (i) a horizontal sync signal (HSYNC) and (ii) a vertical synch signal (VSYNC).

Then, in response to the horizontal sync signal and the vertical synch signal, the timing controller 10 generates a horizontal sync control signal (GCK and the like) and a vertical sync control signal (GSP and the like), respectively. The horizontal sync signal and the vertical synch signal each serve as a video image sync signal, with which the circuits operate in synchronization. Then, the timing controller 10 supplies the horizontal sync control signal (GCK) and the vertical sync control signal (GSP) to each of the gate driver 4 and the source driver 6 (indicated by arrows B and C).

The pause and drive control block 12 supplies, to the source driver 6, AMP_Enable signals in synchronization with the horizontal synch control signal and the vertical sync control signal thus generated. Note that, according to the liquid crystal display device 1, the display panel 2 is driven so as to secure (i) driving periods each of which includes at least two driving frames and (ii) pausing periods each of which includes pausing frames (described later in detail). During the driving frames of the driving periods, the pause and drive control block 12 controls the analogue amplifiers to operate while setting the AMP_Enable signals to be at a high level. During the pausing periods, on the other hand, the pause and drive control block 12 controls the analogue amplifiers to take a pause while setting each of the AMP_Enable signals to be at a low level. The pause and drive control block 12 functions to (a) control any number of frames to be secured for driving frames and (b) control any number of frames to be secured for pausing frames. The pause and drive control block 12 thus functions to flexibly change the respective numbers of the driving frames and the pausing frames.

The source driver 6 uses a horizontal sync control signal as an output timing signal for controlling a timing at which an externally supplied video image signal is supplied to the display panel 2. The gate driver 4 uses the horizontal sync control signal as a timing signal for controlling a timing at which a scan signal is supplied to the display panel 2. The gate driver 4 uses a vertical sync control signal as a timing signal for controlling a timing at which scanning of the scan signal lines G is initiated.

In synchronization with the horizontal sync signal and the vertical synch signal supplied from the timing controller 10, the gate driver 4 initiates scanning of the display panel 2 and then supplies a scan signal to each of the scan signal lines G which are selected in sequence.

On the other hand, in synchronization with the horizontal synch control signal supplied from the timing controller 10, the source driver 6 writes image data (data signal) into each of the data signal lines S of the display panel 2, which image data varies depending on the externally supplied video signal. Note, however, that the source driver 6 writes the image data into the data signal lines S only while the AMP_Enable signals are each maintaining a high level.

Unless specifically stated otherwise, (i) "1 vertical period (1 frame period)" herein means a period controlled by the vertical sync control signal and (ii) "1 horizontal period" herein means a period controlled by the horizontal synch control signal.

(Driving Period and Pausing Period)

Figure 1:
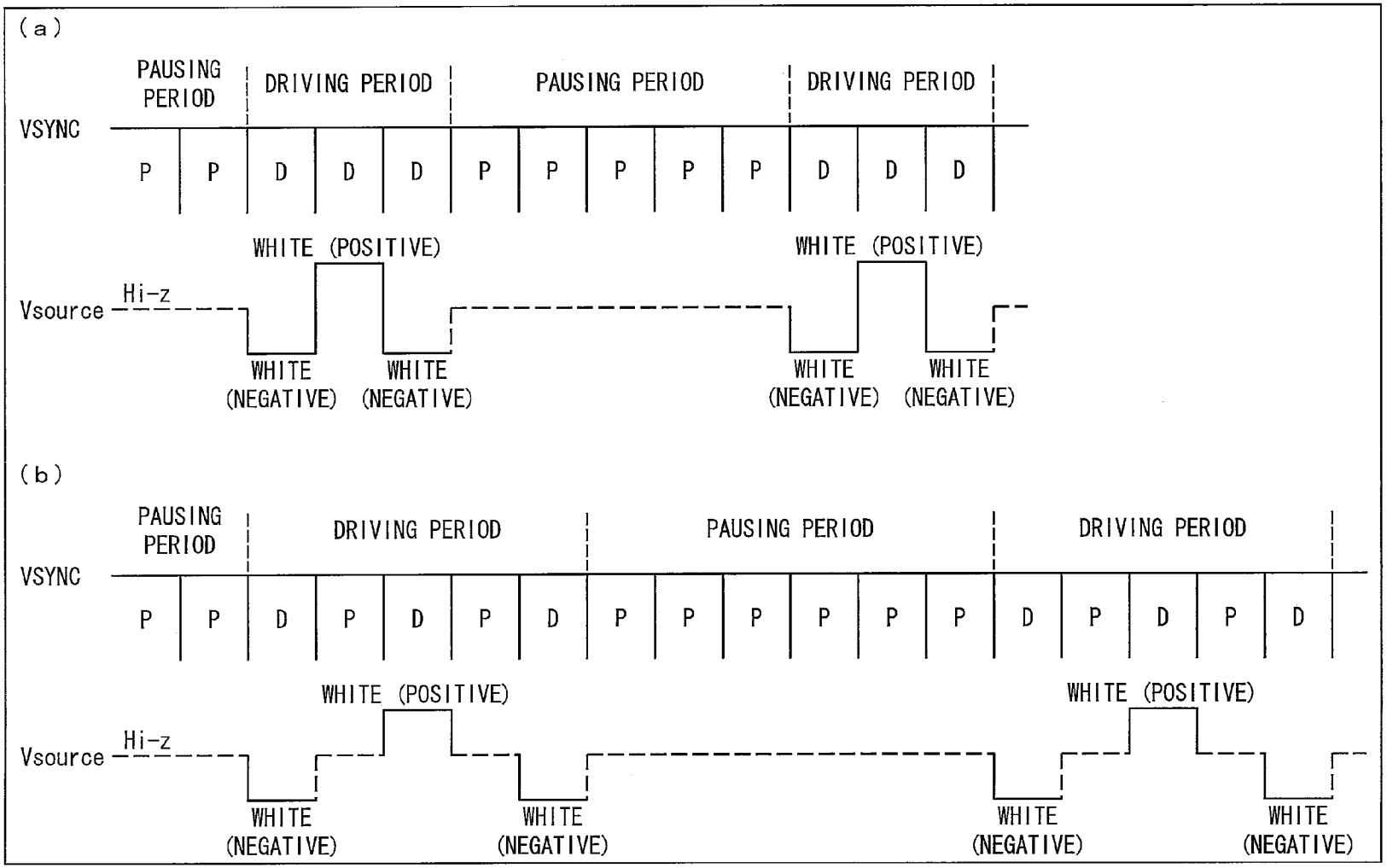
FIG. 1 is a set of views (a) and (b), (a) of FIG. 1 illustrating an example of timings with which a liquid crystal display device in accordance with an embodiment of the present invention is driven in a case where driving frames are consecutively provided in each driving period, and (b) of FIG. 1 illustrating an example of timings with which the liquid crystal display device is driven in a case where driving frames are non-consecutively provided in each driving period.

FIG. 1 illustrates timings at which the liquid crystal display device 1 in accordance with the present embodiment is driven. According to the liquid crystal display device 1, driving periods of certain length and pausing periods of certain length are alternated while the display panel 2 is driven (see FIG. 1). The driving periods are each a period in which (i) AMP_Enable signals outputted from the pause and drive control block 12 are each at a high level and (ii) data signals are written into the respective data signal lines S. On the other hand, the pausing periods are each a period in which (a) the AMP_Enable signals are each at a low level and (b) the data signal are not written into the data signal lines S. Each of the pausing periods is longer than each of the driving periods.

Note that each driving period contains at least two driving frames (indicated by "D" in FIG. 1) in each of which each data signal is written into a corresponding one of the data signal lines S, that is, all the scan signal lines G are scanned. Each pausing period, on the other hand, is made up of pausing frames (indicated by "P" in FIG. 1) in each of which none of the scan signal lines G is scanned, that is, all the scan signal lines G are in a non-scanning state. The pausing periods are secured so as to (i) follow after a driving period and (ii) last until the initiation of a next driving period. In other words, the driving periods and the pausing periods alternate.

During each of the driving periods, driving frames can be secured consecutively so that a driving period is made up only of driving frames (see (a) of FIG. 1). Alternatively, a pausing frame can be secured after each driving frame so that a driving period is made up of driving frames and pausing frames (see (b) of FIG. 1).

Advantageous effects brought about by driving the liquid crystal display device 1 as such will be described below with an example in which the liquid crystal display device 1 is driven at timings illustrated in (a) of FIG. 1. Specifically, in the example, the liquid crystal display device 1 is driven at the timings illustrated in FIG. 3 so that white display is carried out during driving periods.

Figure 3:
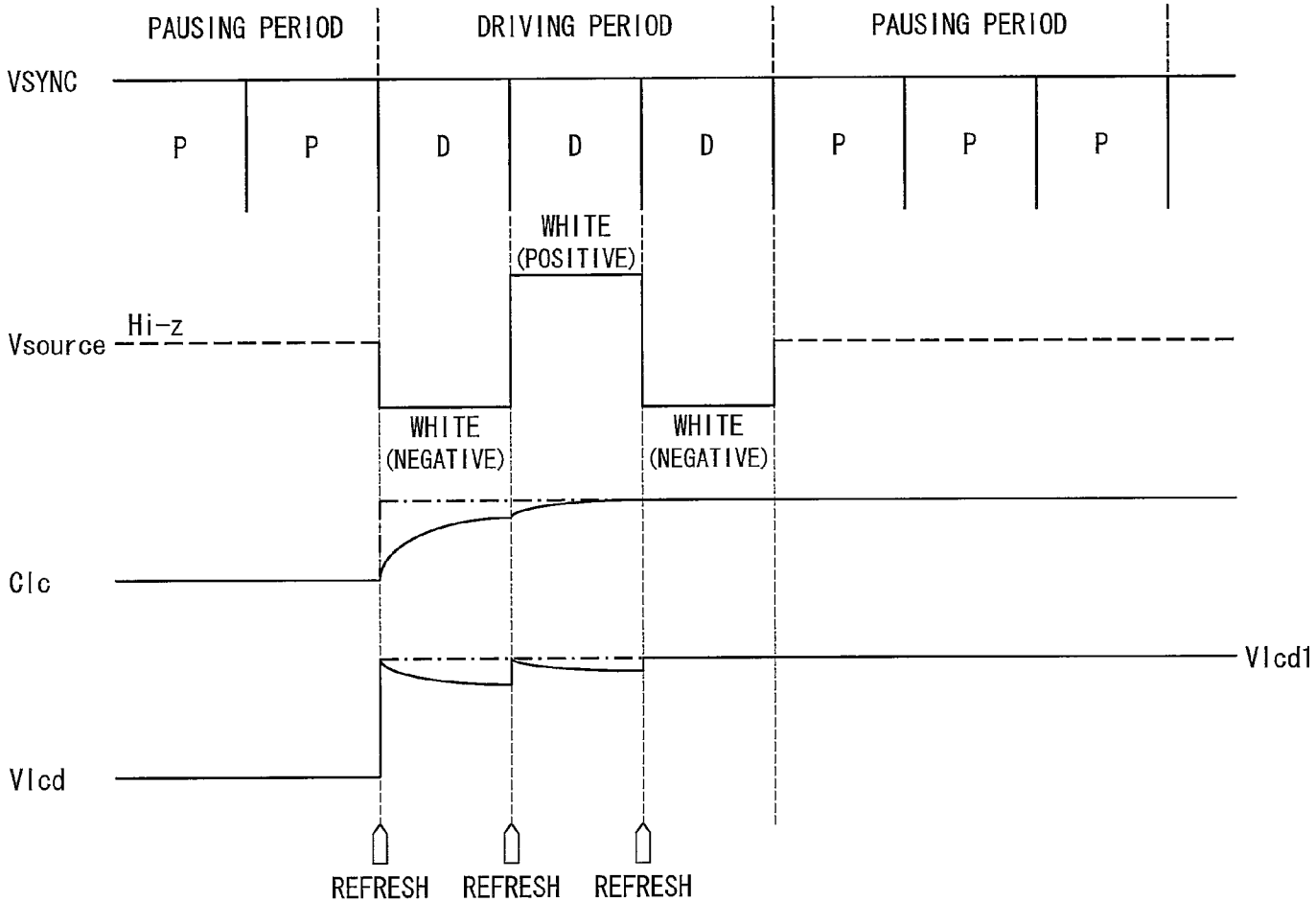
FIG. 3 is a view illustrating an example of timings with which the liquid crystal display device in accordance with the present invention is driven.

In this case, each driving period is made up of three driving frames (see FIG. 3). During a driving period, a voltage Vlcd1, which is necessary for white display, is applied during each driving frame. In other words, the pixels are refreshed during each driving frame. As a result, over a first driving frame, a liquid crystal capacitance Clc does not reach a voltage necessary for white display (a voltage indicated by a dot-and-dash line in FIG. 3), and an applied voltage Vlcd decreases accordingly. However, in response to continuous application of the voltage Vlcd1 over second and third driving frames, the liquid crystal capacitance Clc reaches the capacitance necessary for white display. This causes the applied voltage Vlcd to reach the voltage Vlcd1 as well.

In each driving period, at least two driving frames are secured during each of which data signals are written into the respective data signal lines S, and the pixels are therefore refreshed for each driving period. This causes the liquid crystal capacitance Clc to reach the necessary liquid crystal capacitance within the driving period, and consequently allows the applied voltage Vlcd to reach the necessary voltage. Therefore, it is possible to realize display on the screen without afterimages.

According to the present embodiment, in a case where writing of a data signal into the data signal lines S is completed in a driving period, the source driver 6 has a high output impedance (Hi-Z) during a pausing period. This causes an electric potential at each of the data signal lines S to remain the same, and consequently prevents the electric potential from fluctuating. In so doing, since all the scan signal lines G are set to be in a non-scanning state during a pausing period, a data signal is supplied to none of the data signal lines S. That is, since a data signal is written into none of the data signal lines S during the pausing period, even a high output impedance of the source driver 6 will never affect display on the screen.

According to the liquid crystal display device 1, it is thus possible, without affecting the display on the screen, to cause all the scan signal lines G to be in a non-scanning state. This prevents data signals from being written into the respective data signal lines S, so that driving of any of the circuits is suspended. This allows a reduction in electric-power consumption. Furthermore, according to the present embodiment, each pausing period is set to be longer than each driving period. This allows a sufficient reduction in electric power consumption even though each driving period contains a plurality of driving frames. Hence, it is possible to provide a liquid crystal display device 1 that achieves (i) a reduction in electric power consumption and (ii) high quality display with reduced afterimages.

(The Number of Driving Frames in Driving Period)

The following description will discuss the number of driving frames in a driving period. As has been described in the Background Art section of the present specification, it takes a certain length of time for liquid crystal molecules to be in an alignment state corresponding to an applied voltage. Such a length of time (response time) varies, depending on first and second gradations of a pixel in a gradation transition from the first to the second gradation of the pixel. Furthermore, the liquid crystal molecules have response speeds which vary depending on ambient temperature. Specifically, a lower temperature generally results in a greater length of response time.

Figure 4:
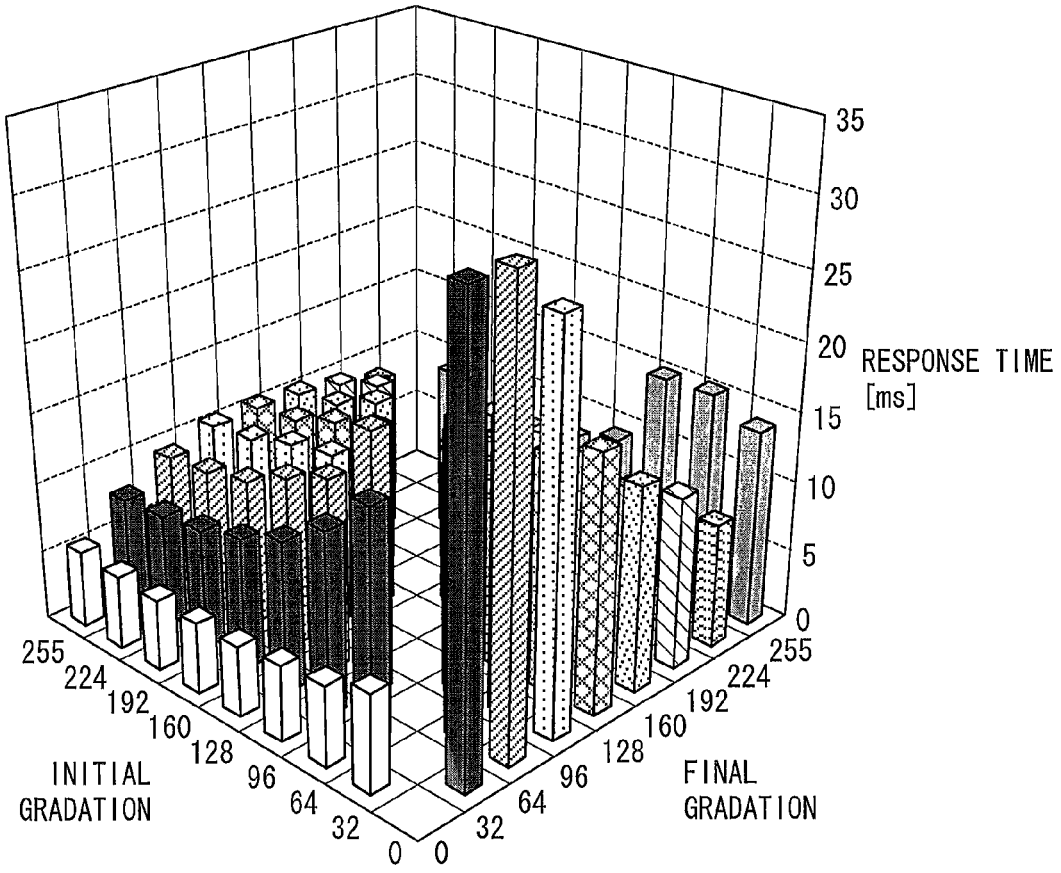
FIG. 4 is a view illustrating a response time of pixels in transition from one gradation to another at a temperature of 50° C.
Figure 5:
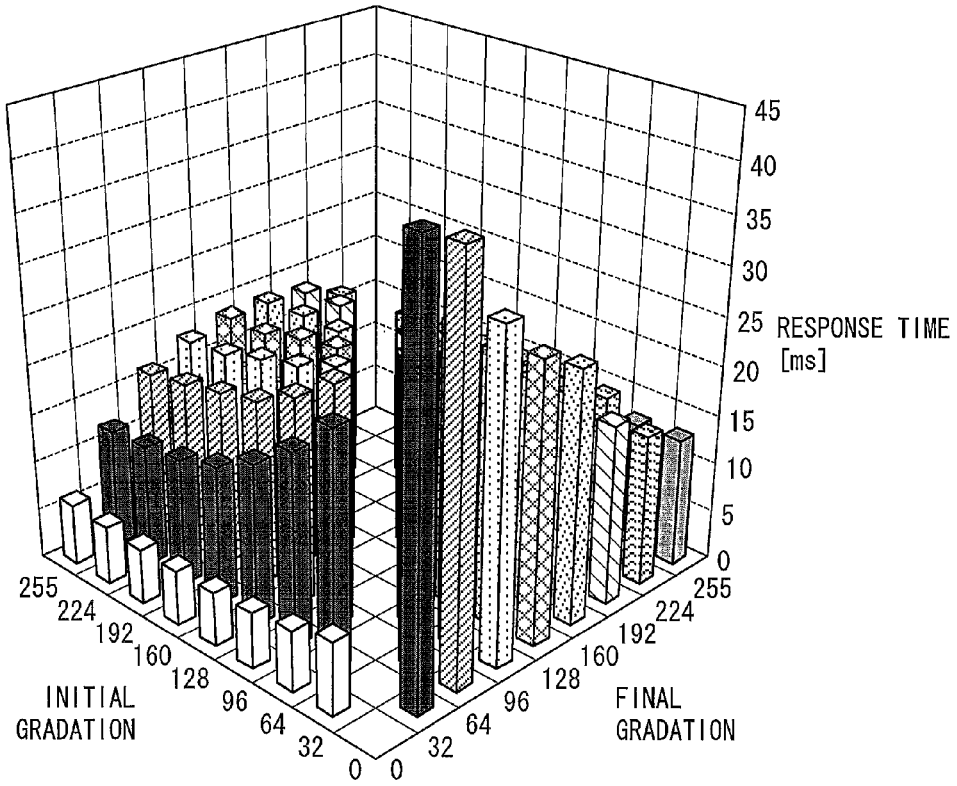
FIG. 5 is a view illustrating a response time of pixels in transition from one gradation to another at a temperature of 25° C.
Figure 6:
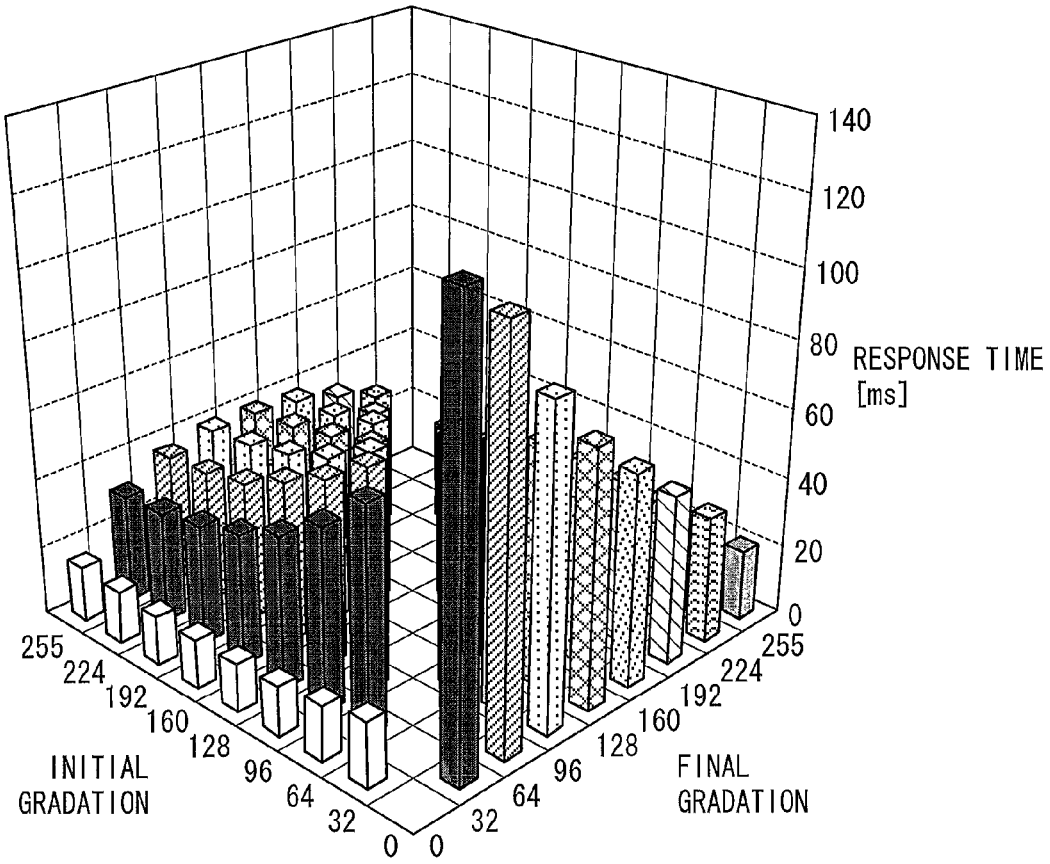
FIG. 6 is a view illustrating a response time of pixels in transition from one gradation to another at a temperature of 0° C.

Tables 1 through 3 illustrate response times during between-gradations periods under conditions where ambient temperature is 50° C., 25° C., and 0° C., respectively. FIGS. 4 through 6 illustrate the results shown in Tables 1 through 3, respectively.

TABLE 1

| Response Time | | Final Gradation 0 | 32 | 64 | 96 | 128 | 160 | 192 | 224 | 255 |
|---|---|---|---|---|---|---|---|---|---|---|
| Initial Grada-tion | 0 | | 32.48 | 32.24 | 28.40 | 18.32 | 14.56 | 12.32 | 8.88 | 14.16 |
| | 32 | 7.04 | | 21.60 | 20.24 | 16.72 | 15.20 | 11.52 | 8.24 | 15.44 |
| | 64 | 5.80 | 16.28 | | 17.20 | 16.56 | 15.28 | 10.64 | 7.76 | 15.28 |
| | 96 | 5.40 | 13.12 | 18.40 | | 15.28 | 12.00 | 9.76 | 7.36 | 9.44 |
| | 128 | 5.08 | 10.80 | 13.72 | 13.64 | | 10.00 | 8.64 | 6.96 | 8.24 |
| | 160 | 5.04 | 9.44 | 12.28 | 12.56 | 13.08 | | 8.48 | 7.12 | 7.60 |
| | 192 | 5.08 | 8.56 | 10.64 | 11.92 | 12.16 | 12.32 | | 6.24 | 7.36 |
| | 224 | 5.20 | 8.12 | 9.92 | 10.96 | 11.00 | 10.88 | 11.00 | | 9.36 |
| | 255 | 5.44 | 7.92 | 9.60 | 10.60 | 10.64 | 10.40 | 9.80 | 8.96 | |

TABLE 2

| Response Time | | Final Gradation 0 | 32 | 64 | 96 | 128 | 160 | 192 | 224 | 255 |
|---|---|---|---|---|---|---|---|---|---|---|
| Initial Grada-tion | 0 | | 43.68 | 41.36 | 33.04 | 28.16 | 25.52 | 18.24 | 15.28 | 13.04 |
| | 32 | 7.40 | | 35.20 | 31.36 | 27.12 | 22.64 | 19.44 | 17.44 | 12.88 |
| | 64 | 6.16 | 23.60 | | 26.08 | 24.88 | 22.08 | 19.68 | 17.92 | 9.92 |
| | 96 | 5.68 | 19.44 | 24.16 | | 21.84 | 20.64 | 19.36 | 17.84 | 8.88 |
| | 128 | 5.48 | 16.32 | 21.04 | 22.28 | | 20.08 | 19.04 | 17.68 | 8.08 |
| | 160 | 5.52 | 14.08 | 18.76 | 20.60 | 20.72 | | 18.72 | 17.52 | 7.68 |
| | 192 | 5.64 | 12.88 | 17.84 | 19.60 | 20.08 | 19.28 | | 17.52 | 7.20 |
| | 224 | 5.88 | 12.24 | 17.00 | 18.44 | 18.92 | 19.28 | 18.84 | | 6.96 |
| | 255 | 6.20 | 12.04 | 16.36 | 18.12 | 19.04 | 19.04 | 18.64 | 16.72 | |

TABLE 3

| Response Time | | Final Gradation 0 | 32 | 64 | 96 | 128 | 160 | 192 | 224 | 255 |
|---|---|---|---|---|---|---|---|---|---|---|
| Initial Grada-tion | 0 | | 128.72 | 116.72 | 91.68 | 73.68 | 60.88 | 48.48 | 36.32 | 20.32 |
| | 32 | 18.80 | | 95.36 | 82.56 | 68.80 | 58.16 | 46.40 | 34.64 | 19.52 |
| | 64 | 16.00 | 64.64 | | 70.00 | 62.80 | 52.80 | 44.64 | 33.68 | 19.28 |
| | 96 | 14.40 | 52.48 | 62.80 | | 54.08 | 49.76 | 40.64 | 32.64 | 18.88 |
| | 128 | 13.68 | 43.60 | 53.68 | 55.52 | | 47.12 | 37.84 | 31.52 | 18.80 |
| | 160 | 13.92 | 37.92 | 47.12 | 48.24 | 46.40 | | 36.08 | 29.92 | 18.40 |
| | 192 | 14.16 | 34.24 | 40.72 | 43.68 | 43.60 | 41.76 | | 27.92 | 18.24 |
| | 224 | 14.88 | 32.00 | 38.08 | 40.96 | 40.96 | 39.12 | 33.84 | | 18.40 |
| | 255 | 16.08 | 31.12 | 37.28 | 39.76 | 39.76 | 38.16 | 34.40 | 28.88 | |

As is clear from Tables 1 through 3 and FIGS. 4 through 6, the length of response time is greatest while the pixels are in a transition from 0 gradation to 32-64 gradations under any conditions. Under the conditions where ambient temperatures are 50° C., 25° C., and 0° C., the response times are approximately 32 ms, approximately 44 ms, and approximately 129 ms, respectively.

TABLE 4

| Temperature | 50° C. | 25° C. | 0° C. |
|---|---|---|---|
| Longest Response Time Recorded | 32 ms | 44 ms | 129 ms |
| Number of Frames Necessary for Data Signal Writing | 2 Frames | 3 Frames | 8 Frames |

In a case where the length of a single frame is 16.7 ms, Table 4 shows the following: At a temperature of 50° C., the longest response time of gradation transitions is approximately 32 ms. Therefore, the gradation transition is made over a period of approximately 2 frames. In other words, it requires approximately 2 frames for a data signal to be written. Likewise, at a temperature of 25° C., the longest response time of gradation transitions is approximately 44 ms. Therefore, the gradation transition is made over a period of approximately 3 frames. In other words, it requires approximately 3 frames for a data signal to be written. Furthermore, at a temperature of 0° C., the longest response time of gradation transitions is approximately 129 ms. Therefore, the gradation transition is made over a period of approximately 8 frames. In other words, it requires approximately 8 frames for a data signal to be written.

Therefore, at a temperature of 50° C., by securing at least 2 driving frames in a driving period, the response is completed within the driving period even in a case of a gradation transition whose response time is the longest. Likewise, at a temperature of 25° C., by securing at least 3 driving frames in a driving period, the response is completed within the driving period even in a case of a gradation transition whose response time is the longest. Furthermore, at a temperature of 0° C., by securing at least 8 driving frames in a driving period, the response is completed within the driving period even in a case of a gradation transition whose response time is the longest.

It is thus preferable that each driving period contains at least as many driving frames corresponding to the longest response time of the gradation transitions from one gradation to another under a given ambient temperature in the liquid crystal display device 1. This allows the driving period to contain at least as many driving frames as it takes for the driving period to be substantially equal to the longest response time of the gradation transition from one gradation to another. Therefore, during any gradation transitions, it is possible for a liquid crystal capacitance Clc to almost certainly reach, within a driving period, a liquid crystal capacitance that is necessary for display. This allows an applied voltage Vlcd to also reach, within the driving period, a voltage necessary for the display. Therefore, it is possible to more certainly reduce the occurrence of afterimages. Note that (a) all of the scan signal lines G are in a non-scanning state during a pausing period and (b) each driving period is set to be longer than each pausing period. This allows for the realization of higher-quality display while maintaining low electric power consumption.

Note that, in a case of controlling the number of driving frames in accordance with a given ambient temperature, it is only necessary (i) to provide a thermometric section (not illustrated) for measuring ambient temperature inside the liquid crystal display device 1 and (ii) for the pause and drive control block 12 to control, in accordance with a temperature measured by the thermometric section, the number of driving frames.

Needless to say, it is possible to realize, only by securing at least two driving frames in each driving period, a liquid crystal display device 1 that achieves (i) a reduction in electric power consumption and (ii) high quality display with sufficiently reduced afterimages.

(TFT Characteristics)

Figure 7:
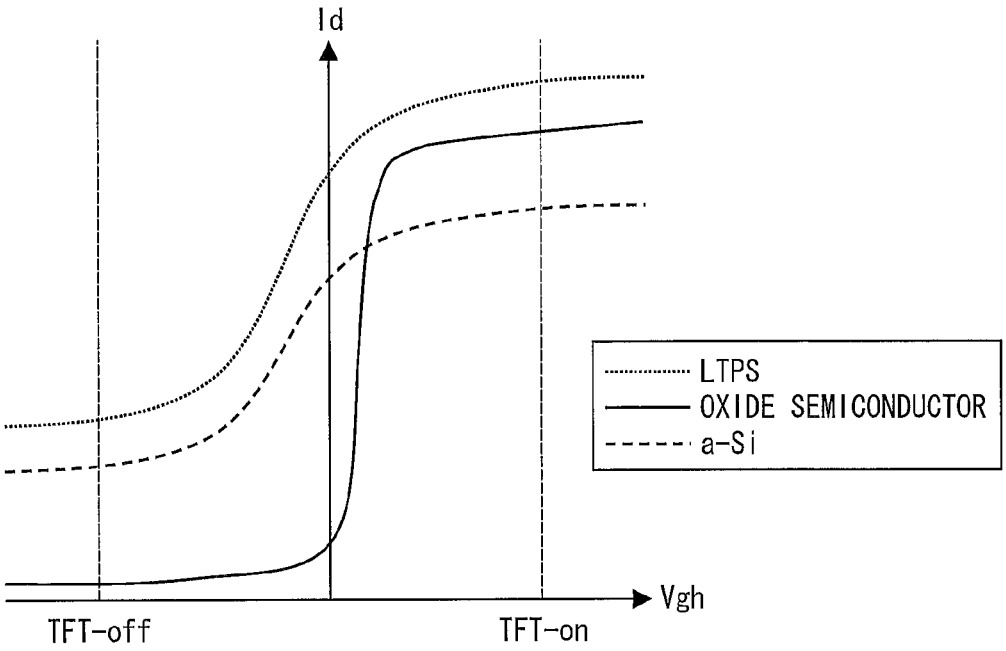
FIG. 7 is a view illustrating respective characteristics of various TFTs.

For the purpose of increasing a speed at which a liquid crystal capacitance reaches a value necessary for display, the liquid crystal display device 1 of the present embodiment preferably employs a TFT whose semiconductor layer is a so-called oxide semiconductor. Examples of such an oxide semiconductor encompass IGZO (InGaZnOx). The reason will be explained below with reference to FIG. 7. FIG. 7 is a view illustrating respective characteristics of various TFTs. Specifically, FIG. 7 illustrates respective characteristics of (i) a TFT in which an oxide semiconductor is used, (ii) a TFT in which an a-Si (amorphous silicon) is used, and (iii) a TFT in which an LTPS (Low Temperature Poly Silicon) is used. In FIG. 7, a horizontal axis (Vgh) indicates an on-voltage applied across a gate of each of the TFTs, and a vertical axis (Id) indicates an amount of electric current flowing from a source to a drain of each of the TFTs. In addition, in FIG. 7, "TFT-on" indicates a time period in which a TFT is in an "on" state in accordance with an on-voltage, and "TFT-off" indicates a time period in which the TFT is in an "off" state in accordance with the voltage of the on-voltage.

As illustrated in FIG. 7, the amount of electric current (i.e., electron mobility) flowing while the TFT with the oxide semiconductor is in an "on" state is larger than the amount of electric current flowing while the TFT with the a-Si is in an "on" state. Specifically, the TFT with the a-Si has an Id electric current of 1 uA while being in an "on" state whereas the TFT with the oxide semiconductor has an Id electric current of approximately 20 uA to 50 uA while being in an "on" state (not illustrated). That is, the TFT with the oxide semiconductor has, in an "on" state, an electron mobility of 20 to 50 times higher than the TFT, with the a-Si, which is in an "on" state. This indicates that the TFT with the oxide semiconductor has excellent "on" characteristic.

Since each pixel of the liquid crystal display device 1 of the present embodiment thus employs a pixel with a TFT whose semiconductor layer is an oxide semiconductor, such a TFT has excellent "on" characteristic. This allows an increase in the amount of electron mobility during writing of each pixel, and therefore allows a reduction in the amount of time required for such writing. That is, according to the liquid crystal display device 1, the liquid crystal capacitance can reach, within a driving period, a liquid crystal capacitance necessary for display. This allows an applied voltage to also reach, within the driving period, a voltage necessary for the display. In so doing, an off-current is preferably made small whereas an on-current is preferably made large by use of an oxide semiconductor such as IGZO. A larger off-current causes a voltage after voltage application to be lowered faster, and a smaller off-current causes a voltage after voltage application to be lowered slower. Therefore, in a case where an off-current is small, a voltage becomes lowered by a small amount. This allows a luminance to remain the same even if a pausing period is made long, and therefore allows a pausing period to last for an extended period of time.

(Modification 1: Driving of Liquid Crystal Display Device 1 by Use of OS Driving)

In recent years, proposals have been made for a driving method (gradation transition enhancement process), called overshoot driving (over drive), which is a technique for improving a response time of liquid crystals. The gradation transition enhancement process (hereinafter referred to as OS driving) is a driving method for improving a response time by accelerating a response of liquid crystals through applying an enhancement voltage to pixels which are to make a gradation transition.

Specifically, in a case where, for example, a pixel makes a transition from gradation A to gradation B which is larger than the gradation A, a voltage (enhancement voltage) is applied to the pixel, which enhancement voltage is higher than a writing voltage for the gradation B. This accelerates a change in alignment of liquid crystal molecules, and therefore increases a response speed of liquid crystals. Hence, it is possible to further accelerate a response speed of the pixel in transition from the gradation A to the gradation B. Note that, in a case where a pixel makes a transition from the gradation A to gradation C which is smaller than the gradation A, an effect similar to the above response-accelerating effect can be obtained by applying a voltage (enhancement voltage) to the pixel, which enhancement voltage is lower than a writing voltage for the gradation C.

Figure 8:
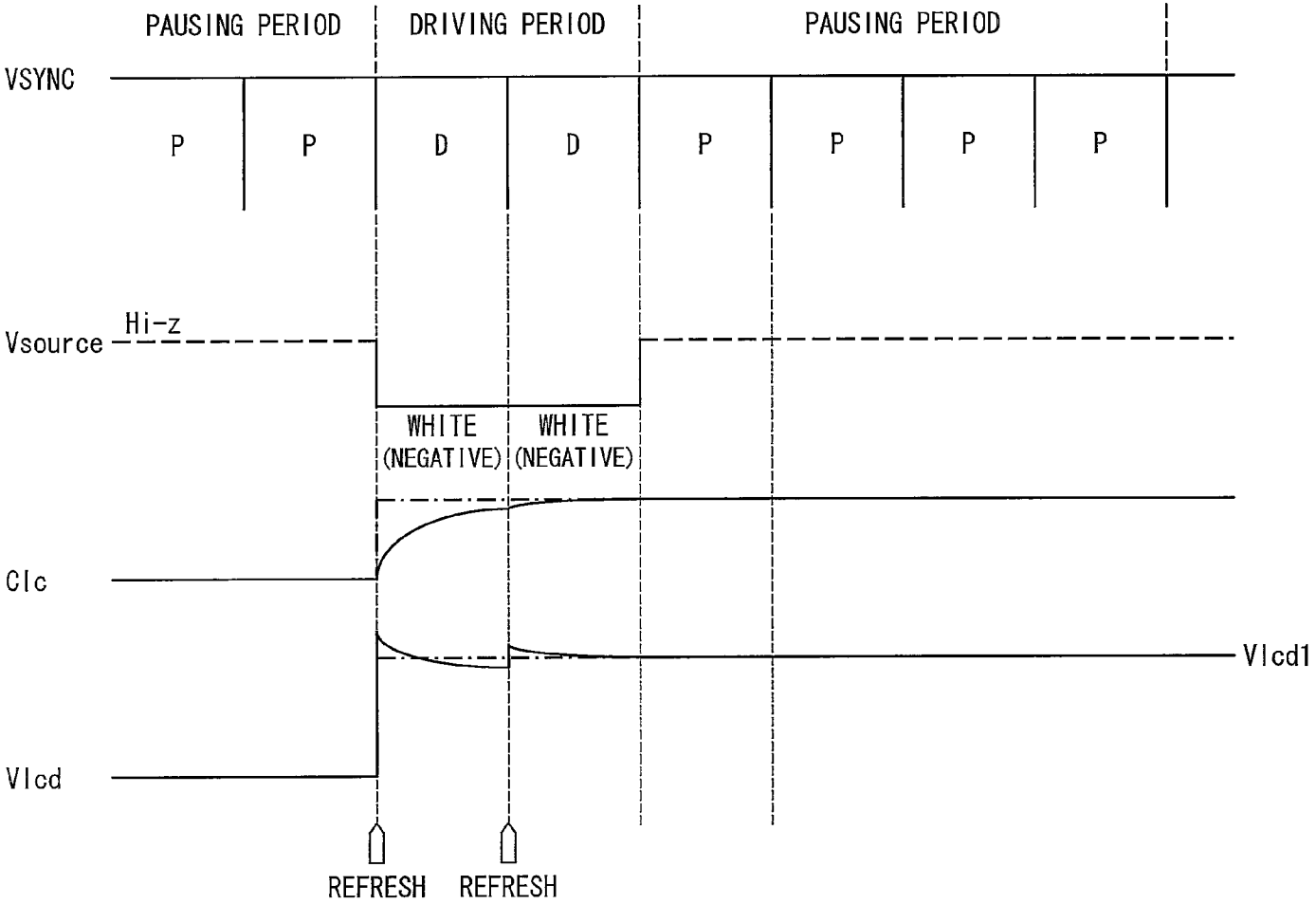
FIG. 8 is a view illustrating an example of timings at which the liquid crystal display device in accordance with the present invention is driven by use of OS driving.

The OS driving can be applied to the liquid crystal display device 1 of the present embodiment. An example, in which the OS driving is applied to the liquid crystal display device 1, will be described below with reference to FIG. 8. FIG. 8 is a view illustrating timings at which the liquid crystal display device 1 is driven by use of the OS driving in such an example.

Let it be assumed that the liquid crystal display device 1 is driven at timings illustrated in FIG. 8 and that white display is carried out in driving periods. In this case, each of the driving periods is made up of two driving frames (see FIG. 8). Since OS driving is carried out during the driving period, an enhancement voltage (which is a gradation signal which has been subjected to a gradation enhancement process) is applied during each driving frame. As a result, in a first driving frame, a response speed of liquid crystals is accelerated and therefore a liquid crystal capacitance Clc reaches substantially a liquid crystal capacitance (indicated by a dot-and-dash line in FIG. 8) which is necessary for white display. Then, in a case where the enhancement voltage is continuously applied during a second (following) driving frame, the liquid crystal capacitance Clc reaches the liquid crystal capacitance necessary for the white display, so that an applied voltage Vlcd reaches a voltage Vlcd1 which is also necessary for the white display.

The response speed of the liquid crystals is thus accelerated by carrying out the OS driving during driving periods. This causes the liquid crystal capacitance Clc to even more rapidly reach the necessary liquid crystal capacitance. In so doing, since each of the driving periods contains at least two driving frames, the liquid crystal capacitance Clc can more certainly reach the necessary liquid crystal capacitance within the driving period. This allows the applied voltage Vlcd to more certainly reach, within the driving period, the voltage necessary for the display. Therefore, it is possible to achieve display on the screen with reduced afterimages. In so doing, (i) all the scan signal lines G are set to be in a non-scanning state during pausing periods and (ii) each pausing period is set to be longer than each driving period. This allows for high-quality display while maintaining low electric power consumption.

[Enhancement Voltage in OS Driving]

The following description will discuss, with reference to FIGS. 9 through 12, an enhancement voltage to be applied during OS driving. (a) of each of FIGS. 9 through 12 is a view illustrating (i) a gradation to be written during OS driving and (ii) a gradation to be written during normal driving. (b) of each of FIGS. 9 through 12 is a view illustrating (i) how a liquid crystal capacitance Clc changes during OS driving and (ii) how a liquid crystal capacitance Clc changes during normal driving.

According to the OS driving, as has been described, in a case where a pixel makes a transition from gradation A to gradation B which is larger than the gradation A, a voltage (enhancement voltage) is applied to the pixel, which enhancement voltage is higher than a writing voltage for the gradation B. On the other hand, in a case where a pixel makes a transition from gradation A to gradation C which is smaller than the gradation A, a voltage (enhancement voltage) is applied to the pixel, which enhancement voltage is lower than a writing voltage for the gradation C.

Figure 9:
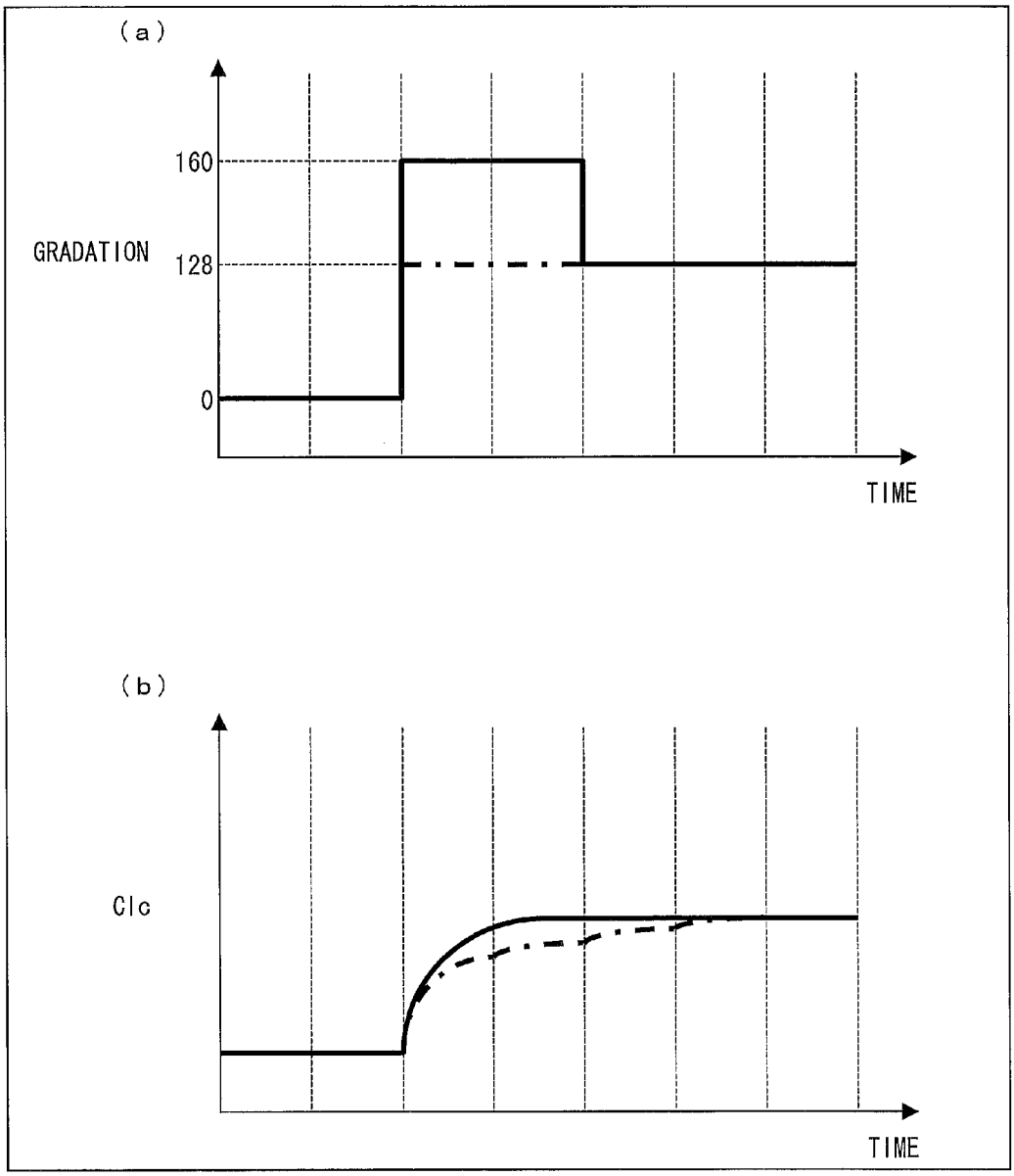
FIG. 9 is a set of views (a) and (b), (a) of FIG. 9 illustrating respective gradations to be written during OS driving and normal driving correspond, and (b) of FIG. 9 illustrating respective liquid crystal capacitances during the OS driving and the normal driving.
Figure 10:
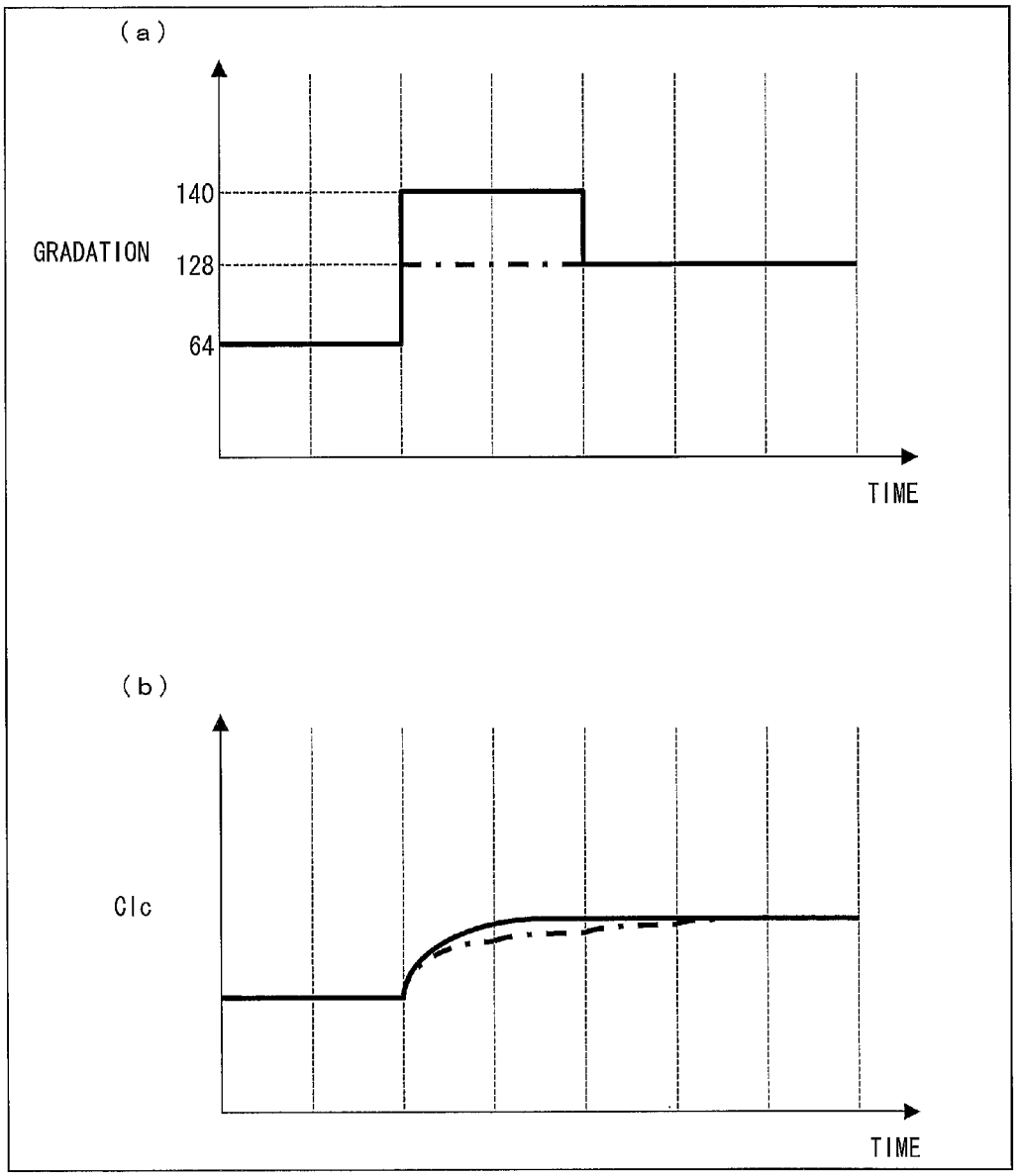
FIG. 10 is a set of views (a) and (b), (a) of FIG. 10 illustrating respective gradations to be written during OS driving and normal driving correspond, and (b) of FIG. 10 illustrating respective liquid crystal capacitances during the OS driving and the normal driving.
Figure 11:
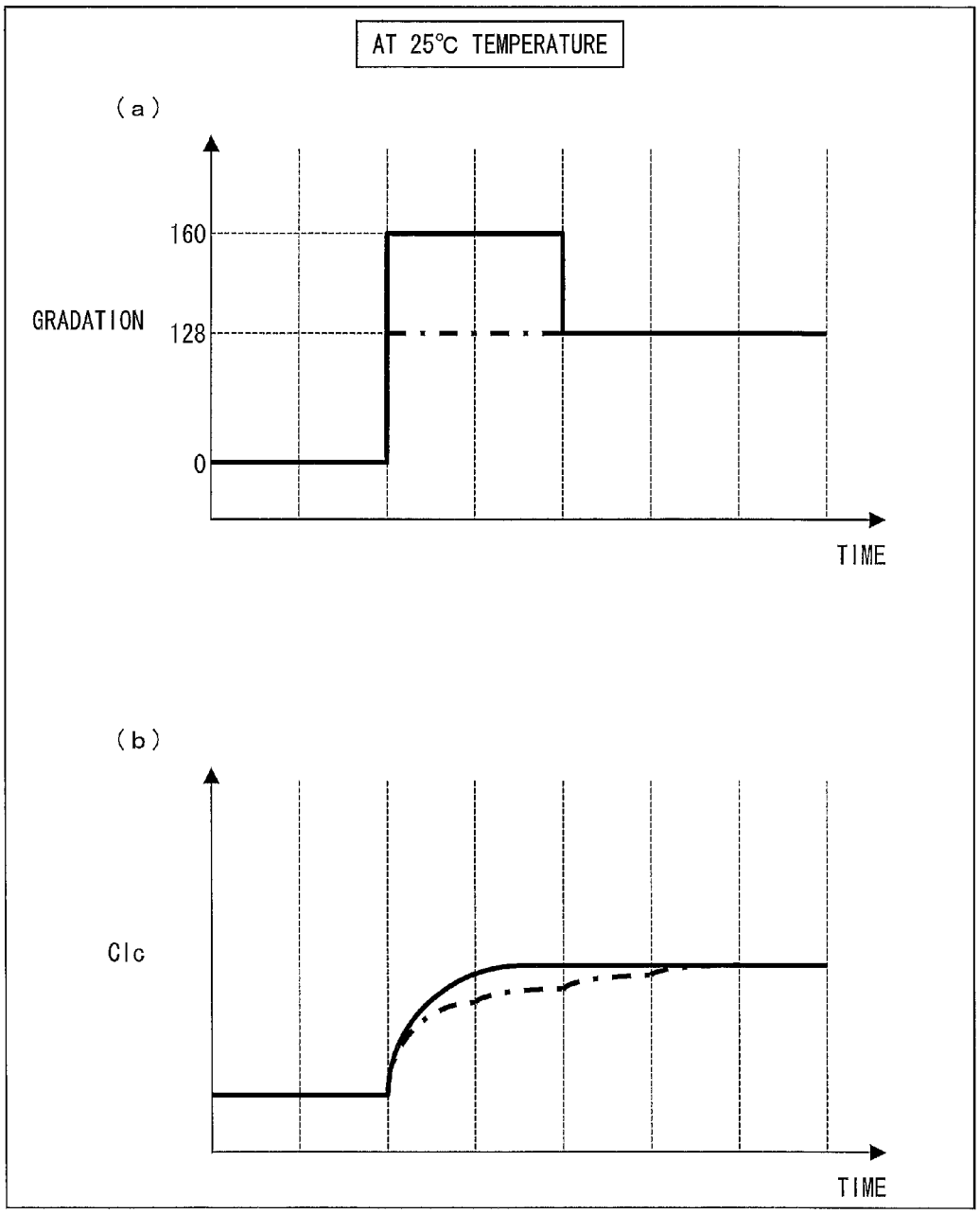
FIG. 11 is a set of views (a) and (b), (a) of FIG. 11 illustrating respective gradations to be written during OS driving and normal driving correspond, and (b) of FIG. 11 illustrating respective liquid crystal capacitances during the OS driving and the normal driving.

For example, in a case where a transition is made from 0 gradation to 128 gradation as illustrated in (a) of FIG. 9, 160 gradation is to be written. This, as illustrated in (b) of FIG. 9), causes a time period, required for the liquid crystal capacitance Clc to reach a liquid crystal capacitance corresponding to 128 gradation, to be shorter in a case of the OS driving (indicated by a solid line in (b) of FIG. 9) than that in a case of the normal driving (indicated by a dotted line in (b) of FIG. 9). This is because a response speed of liquid crystals has become faster as a result of the application of an enhancement voltage during a gradation transition as described above. Likewise, in a case where a transition is made from 64 gradation to 128 gradation as illustrated in (a) and (b) of FIG. 10, writing of 140 gradation shortens a time period required for the liquid crystal capacitance Clc to reach a liquid crystal capacitance corresponding to 128 gradation. Each of the enhancement voltages is obtained by (i) carrying out an arithmetical operation based on gradations before and after a transition and (ii) calculating a gradation (i.e., an enhancement voltage) to be written into a pixel which is subjected to the gradation transition. Note that, since the OS driving is a well-known technique, the description of a specific method of calculating an enhancement voltage will be omitted.

As has been early described, a response speed of liquid crystals varies, depending on ambient temperature. Specifically, a lower ambient temperature generally causes a longer response time. Therefore, application of an enhancement voltage based on ambient temperature is desirable even in a case of OS driving. Therefore, in a case where a transition is made from 0 gradation to 128 gradation, 160 gradation is written at an ambient temperature of, for example, 25° C. (see (a) of FIG. 11). At an ambient temperature of 0° C., on the other hand, 190 gradation is written (see (a) of FIG. 12). This (I) causes, at a temperature of 25° C., a time period required for the liquid crystal capacitance Clc to reach a liquid crystal capacitance corresponding to 128 gradation to be shorter in a case of OS driving (indicated by a solid line in (b) of FIG. 11) than that in a case of normal driving (indicated by a dotted line in (b) of FIG. 11) (see (b) of FIG. 11) and (II) causes, at a temperature of 0° C., a time period for the liquid crystal capacitance Clc to reach a liquid crystal capacitance corresponding to 128 gradation to be shorter in a case of OS driving (indicated by a solid line in (b) of FIG. 12) than that in a case of normal driving (indicated by a dotted line in (b) of FIG. 12) (see (b) of FIG. 12). This is because, even in the case where a response speed of liquid crystals during a gradation transitions is lowered due to ambient temperature, the response speed has become faster as a result of the application of an enhancement voltage corresponding to the ambient temperature.

As has been described, even in a case where a response speed of liquid crystals has been lowered during OS due to ambient temperature, the response speed can more certainly be made faster by application of an enhancement voltage corresponding to the ambient temperature. As a result, a liquid crystal capacitance Clc more certainly reaches, within a driving period, a liquid crystal capacitance necessary for display. This causes an applied voltage Vlcd to more certainly reach, within the driving period, a voltage necessary for the display. Therefore, it is possible to more certainly reduce the occurrence of afterimages on a screen. Note that, (i) all of the scan signal lines G are in a non-scanning state during a pausing period and (ii) each driving period is set to be longer than each pausing period. This allows for the realization of higher-quality display while maintaining lower electric power consumption.

Note that the description of a specific method of calculating an enhancement voltage corresponding to ambient temperature will also be omitted.

(Modification 2: Driving of Liquid Crystal Display Device 1 by Use of Reverse Polarity Driving Method)

In a case where (i) a liquid crystal display device is driven and (ii) a direct-current voltage (DC voltage) is applied to liquid crystal molecules for an extended period of time, characteristic deteriorations occur, such as image sticking. There is a method that employs, in order to prevent such characteristic deteriorations, a reverse polarity driving method in which a liquid crystal display device is driven while a polarity of an applied voltage is switched periodically.

It is possible to apply the reverse polarity driving method to the liquid crystal display device 1 of the present embodiment. The following description will discuss a case where the liquid crystal display device 1 (i) employs a reverse polarity driving method and (ii) is driven at timings illustrated in FIG. 13.

In the case where the reverse polarity driving method is applied to the liquid crystal display device 1, a polarity of a data signal to be supplied to a corresponding pixel during a last driving frame in a first driving period is to differ from a polarity of a data signal to be supplied to a corresponding pixel during a last driving frame of a second driving period by which the first driving period is followed. In other words, as to the last driving frames in the respective driving periods, polarities of data signals, which are to be supplied during last driving frames in the respective driving periods, are to alternate. For example, in a case where the liquid crystal display device 1 is driven as illustrated in FIG. 13, a polarity of a data signal supplied during a third (last) driving frame in a driving period is negative. This means that a polarity of a data signal to be supplied during a third (last) driving frame of a next driving period is to be positive.

Note that, whether or not characteristic deteriorations such as image sticking occur is determined by whether or not polarities of respective voltages applied during adjacent pausing periods are alternated. Therefore, except for the last driving frames of the respective driving periods, it is possible (i) to reverse a polarity of a data signal for every driving frame or (ii) to reverse a polarity of a data signal for every predetermined number of driving frames. Alternatively, it is also possible not to reverse a polarity of a data signal at all as illustrated in FIG. 13. In a case where, as illustrated in FIG. 13, a polarity of a data signal is not reversed at all (i.e. in a case where data signals supplied during the last driving frame of the respective driving periods have the same polarity as that of data signals supplied during other driving frames), it is possible to eliminate the need for consuming electric power required for reversing polarities of data signals.

The present invention is not limited to the description of the embodiments, but can be altered in many ways by a person skilled in the art within the scope of the claims. An embodiment derived from a proper combination of technical means disclosed in different embodiments is also encompassed in the technical scope of the present invention.

SUMMARY OF EMBODIMENTS

As has been described, in order to attain the object, the liquid crystal display device in accordance with the embodiment of the present invention includes: a plurality of scan signal lines; a plurality of data signal lines; pixels provided for intersections of the plurality of scan signal lines and the plurality of data signal lines; a scan signal line drive circuit for selectively scanning the scan signal lines; a data signal line drive circuit for supplying data signals via the respective plurality of data signal lines; and a drive control section for controlling the scan signal line drive circuit (i) to scan all of the plurality of scan signal lines during at least two driving frames contained in a first driving period and (ii) not to scan any of the plurality of scan signal lines during pausing frames in a pausing period which (i) is secured between the first driving period and a second driving period by which the first driving period is followed and (ii) is longer than each of the first and second driving periods.

According to the configuration, the data signals (voltages necessary for display) are written into the respective data signal lines during the driving frames of a driving period. In other words, the pixels are refreshed in each driving frame. Consequently, over a first driving frame, a liquid crystal capacitance does not reach a liquid crystal capacitance necessary for display, and an applied voltage decreases accordingly. However, the voltage necessary for the display is applied again over second and subsequent driving frames, the liquid crystal capacitance reaches the value necessary for display. This causes the applied voltage to reach the necessary voltage as well.

Each driving period thus includes at least two driving frames in each of which data signals are written into the respective data signal lines, and therefore the pixels are thus refreshed in each driving frame. This allows the liquid crystal capacitance to reach the necessary liquid crystal capacitance within the driving period, and consequently allows the applied voltage to reach the necessary voltage within the driving period. Therefore, it is possible to realize display on the screen without afterimages.

Additionally, according to the liquid crystal display device, all the scan signal lines are in a non-scanning state in which not to scan the signal lines. This prevents data signals from being written into the respective data signal lines, so that driving of any of the circuits is suspended. This allows for a reduction in electric power consumption. Furthermore, each pausing period is set to be longer than each driving period. This allows for a sufficient reduction in electric power consumption even though each driving period contains a plurality of driving frames. Hence, it is possible to provide a liquid crystal display device that (i) achieves a reduction in electric power consumption and (ii) achieves high quality display with reduced afterimages.

The liquid crystal display device is configured such that the first and second driving periods each contain at least so many driving frames as to correspond to a longest response time required for a transition of a pixel, at a temperature inside the liquid crystal display device, from a first gradation to a second gradation which is different from the first gradation.

It takes a certain length of time for liquid crystal molecules to be in an alignment state corresponding to an applied voltage. Such a length of time (response time) varies, depending on first and second gradations of a pixel in a gradation transition from the first to the second gradation of the pixel. Furthermore, the response time also varies, depending on ambient temperature. Specifically, a lower temperature generally results in a greater length of response time. The configuration allows the driving period to contain at least as many driving frames as it takes for the driving period to be substantially equal to the longest response time of the gradation transition from one gradation to another. Therefore, during any gradation transitions, it is possible for a liquid crystal capacitance to almost certainly reach, within a driving period, a liquid crystal capacitance that is necessary for display. This allows an applied voltage to also reach, within the driving period, a voltage necessary for the display. Therefore, it is possible to more certainly reduce the occurrence of afterimages. Note that (a) all of the scan signal lines are in a non-scanning state during a pausing period and (b) each driving period is set to be longer than each pausing period. This allows for the realization of higher-quality display while maintaining low electric power consumption.

The liquid crystal display device is configured such that, during each of the driving frames, the data signal line drive circuit supplies gradation signals each of which is a data signal having been subjected to a gradation enhancement process, as the data signals, to pixels to be subjected to transition from a first gradation to a second gradation which is different from the first gradation, via the plurality of data signal lines.

According to the configuration, the response speed of the liquid crystals is thus accelerated by carrying out the gradation enhancement process during driving periods. This causes the liquid crystal capacitance to even more rapidly reach the necessary liquid crystal capacitance. In so doing, since each of the driving periods contains at least two driving frames, the liquid crystal capacitance can more certainly reach the necessary liquid crystal capacitance within the driving period. This allows the applied voltage to more certainly reach, within the driving period, the voltage necessary for the display. Therefore, it is possible to achieve display on the screen with reduced afterimages. In so doing, (i) all the scan signal lines are set to be in a non-scanning state during pausing periods and (ii) each pausing period is set to be longer than each driving period. This allows for high-quality display while maintaining low electric power consumption.

The liquid crystal display device is further configured such that, during each of the driving frames, the data signal line drive circuit supplies, via the plurality of data signal lines, gradation signals each of which has been subjected to a gradation enhancement process in accordance with a temperature inside the liquid crystal display device.

A response speed of liquid crystals varies, depending on ambient temperature. Specifically, a lower temperature generally causes a longer response time. According to the configuration, even in a case where a response speed of liquid crystals during the gradation enhancement process has been lowered due to ambient temperature, the response speed can be made faster by application of an enhancement voltage corresponding to the temperature. As a result, a liquid crystal capacitance more certainly reaches, within a driving period, a liquid crystal capacitance necessary for display. This allows an applied voltage to more certainly reach, within the driving period, a voltage necessary for the display. Therefore, it is possible to more certainly reduce the occurrence of afterimages on a screen. Note that, (i) all of the scan signal lines are in a non-scanning state during a pausing period and (ii) each driving period is set to be longer than each pausing period. This allows for the realization of higher-quality display while maintaining lower electric power consumption.

The liquid crystal display device is further configured such that polarities of data signals to be supplied during a last driving frame of the first driving period are different from polarities of data signals to be supplied during a last driving frame of the second driving period.

In a case where (i) a liquid crystal display device is driven and (ii) a direct-current voltage (DC voltage) is applied to liquid crystal molecules for an extended period of time, there is a risk that characteristic deteriorations occur, such as image sticking. With the configuration that employs a reverse polarity driving method in which a liquid crystal display device is driven while a polarity of an applied voltage is switched periodically, it is possible to prevent the characteristic deteriorations such as image sticking.

The liquid crystal display device is further configured such that each of the first and second driving periods is made up only of driving frames.

The liquid crystal display device is further configured such that: each of the first and second driving periods contains driving frames and a pausing frame; and the pausing frame is provided so as to follow after the driving frame.

According to the configuration, each driving period can (i) be made up only of driving frames by securing the driving frames consecutively or (ii) include (a) driving frames which are provided non-consecutively and (b) pausing frames.

The liquid crystal display device is further configured such that an oxide semiconductor is employed as a semiconductor layer of a TFT which is provided in each of the pixels.

It is preferable to further configure the liquid crystal display device such that the oxide semiconductor is IGZO.

According to the configuration, an oxide semiconductor having a relatively high electron mobility (such as IGZO) is used for a TFT in each pixel. This causes an increase in the amount of electron mobility during writing of each pixel, and therefore allows for a reduction in the length of time required for such writing. Hence, the liquid crystal capacitance can reach, within a driving period, a liquid crystal capacitance necessary for display. This causes an applied voltage to also reach, within the driving period, a voltage necessary for the display. In so doing, an off-current is preferably made small whereas an on-current is preferably made large by use of an oxide semiconductor. A larger off-current causes a voltage after voltage application to be lowered faster, and a smaller off-current causes a voltage after voltage application to be lowered slower. Therefore, in a case where an off-current is small, a voltage becomes lowered by a small amount. This allows a luminance to remain the same even if a pausing period is made long, and therefore allows a pausing period to last for an extended period of time.

In order to attain the object, a method in accordance with the embodiment of the present invention is a method of driving a liquid crystal display device, said liquid crystal display device including: a plurality of scan signal lines; a plurality of data signal lines; pixels provided for intersections of the plurality of scan signal lines and the plurality of data signal lines; a scan signal line drive circuit for selectively scanning the scan signal lines; a data signal line drive circuit for supplying data signals via the respective plurality of data signal lines; and said method including the step of: controlling the scan signal line drive circuit (i) to scan all of the plurality of scan signal lines during at least two driving frames contained in a first driving period and (ii) not to scan any of the plurality of scan signal lines during pausing frames in a pausing period which (i) is secured between the first driving period and a second driving period by which the first driving period is followed and (ii) is longer than each of the first and second driving periods.

With the configuration, it is possible to reduce electric power consumption while achieving high quality display with reduced afterimages.

The embodiments and the concrete examples, which have been discussed in the detailed description, are illustrative only, which should not be narrowly interpreted within the limits of such embodiments and concrete examples, but are rather meant to be applied in any variations within the spirit of the present invention, provided that such variations do not exceed the scope of the patent claims set forth below.

INDUSTRIAL APPLICABILITY

A liquid crystal display device of the present invention is applicable to display sections of devices such as mobile phones, smartphones, and laptop personal computers.

REFERENCE SIGNS LIST

1 Liquid crystal display device
2 Display panel
3 TFT
4 Gate driver
5 Pixel electrode
6 Source driver
8 Common electrode drive circuit
10 Timing controller
12 Pause and drive control block

The invention claimed is:

1. A liquid crystal display device comprising:

a plurality of scan signal lines;

a plurality of data signal lines;

pixels provided at intersections of the plurality of scan signal lines and the plurality of data signal lines;

a scan signal line drive circuit that selectively scans the scan signal lines;

a data signal line drive circuit that supplies data signals via the respective plurality of data signal lines;

a drive controller that controls the scan signal line drive circuit (i) to scan all of the plurality of scan signal lines during at least two driving frames contained in a first driving period and (ii) not to scan any of the plurality of scan signal lines during pausing frames in a pausing period which (i) is secured between the first driving period and a second driving period by which the first driving period is followed and (ii) is longer than each of the first and second driving periods; and a temperature sensor that measures a temperature inside the liquid crystal display device; wherein the scan signal line drive circuit outputs a vertical sync control signal, a period of which corresponds to one frame, the vertical sync control signal controlling a timing at which scanning of the scan signal lines is initiated;

a total number of frames in the pausing period is larger than a total number of frames in the first driving period;

the first and second driving periods each contain driving frames which correspond to a longest response time required for a transition of the pixels due to the temperature inside the liquid crystal display device from a first gradation to a second gradation which is different from the first gradation;

the drive controller controls a number of the driving frames in accordance with the temperature inside the liquid crystal display device; and the number of the driving frames is increased as the temperature inside the liquid crystal display device decreases.

2. The liquid crystal display device as set forth in claim 1, wherein, during each of the driving frames, the data signal line drive circuit supplies gradation signals each of which is a data signal having been subjected to a gradation enhancement process, as the data signals, to pixels to be subjected to transition from a first gradation to a second gradation which is different from the first gradation, via the plurality of data signal lines.

3. The liquid crystal display device as set forth in claim 2, wherein, during each of the driving frames, the data signal line drive circuit supplies, via the plurality of data signal lines, gradation signals each of which has been subjected to a gradation enhancement process in accordance with a temperature inside the liquid crystal display device.

4. The liquid crystal display device as set forth in claim 1, wherein polarities of data signals to be supplied during a last driving frame of the first driving period are different from polarities of data signals to be supplied during a last driving frame of the second driving period.

5. The liquid crystal display device as set forth in claim 1, wherein each of the first and second driving periods is made up only of driving frames.

6. The liquid crystal display device as set forth in claim 1, wherein:

each of the first and second driving periods contains driving frames and a pausing frame; and the pausing frame is provided so as to follow after the driving frames.

7. The liquid crystal display device as set forth in claim 1, wherein an oxide semiconductor is employed as a semiconductor layer of a TFT which is provided in each of the pixels.

8. The liquid crystal display device as set forth in claim 7, wherein the oxide semiconductor is InGaZnOx.

9. A method of driving a liquid crystal display device, said liquid crystal display device comprising:

a plurality of scan signal lines;

a plurality of data signal lines;

pixels provided for intersections of the plurality of scan signal lines and the plurality of data signal lines;

a scan signal line drive circuit that selectively scans the scan signal lines;

a data signal line drive circuit that supplies data signals via the respective plurality of data signal lines;

a temperature sensor that measures a temperature inside the liquid crystal display device;

said method comprising the step of:

controlling the scan signal line drive circuit (i) to scan all of the plurality of scan signal lines during at least two driving frames contained in a first driving period and (ii) not to scan any of the plurality of scan signal lines during pausing frames in a pausing period which (i) is secured between the first driving period and a second driving period by which the first driving period is followed and (ii) is longer than each of the first and second driving periods; wherein the scan signal line drive circuit outputs a vertical sync control signal, a period of which corresponds to one frame, the vertical sync control signal controlling a timing at which scanning of the scan signal lines is initiated;

a total number of frames in the pausing period is larger than a total number of frames in the first driving period;

the first and second driving periods each contain driving frames which correspond to a longest response time required for a transition of the pixels due to the temperature inside the liquid crystal display device from a first gradation to a second gradation which is different from the first gradation;

the controlling step controls a number of the driving frames in accordance with the temperature inside the liquid crystal display device; and the number of the driving frames is increased as the temperature inside the liquid crystal display device decreases.

* * * * *